United States Patent [19]

Frahm

[11] Patent Number: 5,002,199

[45] Date of Patent: Mar. 26, 1991

[54] STACKABLE BOTTLE

[75] Inventor: Carl E. Frahm, Arcadia, Calif.

[73] Assignee: Reid Valve Company, Inc., Arcadia, Calif.

[21] Appl. No.: 70,612

[22] Filed: Jul. 9, 1987

Related U.S. Application Data

[63] Continuation of Ser. No. 859,457, May 5, 1986, abandoned.

[51] Int. Cl.[5] ..... B65D 21/00

[52] U.S. Cl. ..... 220/670; 206/509; 215/1 C; 215/10

[58] Field of Search ..... 720/72, 23.4, 23.6; 215/10, 1 C; 206/509; 220/670

[56] References Cited

U.S. PATENT DOCUMENTS

| | | | |
|---|---|---|---|
| 3,369,658 | 2/1968 | Hasselmann | 220/23.4 X |
| 3,474,843 | 10/1969 | Maris | 215/10 X |
| 3,889,834 | 6/1975 | Harris, Jr. | 215/10 |
| 3,976,228 | 8/1976 | Robbins | 206/504 X |
| 4,308,955 | 1/1982 | Schieser et al. | 220/72 X |
| 4,339,049 | 7/1982 | Gillespie | 220/23.4 |
| 4,513,865 | 4/1985 | Melzi et al. | 206/509 X |
| 4,609,106 | 9/1986 | Gentili | 220/72 X |

FOREIGN PATENT DOCUMENTS

| | | | |
|---|---|---|---|
| 263450 | 7/1963 | Australia | 220/23.6 |
| 869392 | 5/1961 | United Kingdom | 215/10 |

*Primary Examiner*—Steven M. Pollard
*Attorney, Agent, or Firm*—Lyon & Lyon

[57] ABSTRACT

An improved light weight liquid-containing stackable bottle made of plastic such as polycarbonate. The bottle is preferably of rectangular cross-section with parallel oppositely disposed mating sides which permits secure and space-saving stacking of the bottles. Complementary projections and receptacles are formed in the mating sides of the bottle to permit interlocking of the bottles when they are stacked. Desirably, vertical and horizontal corrugation are formed in the sides of the bottle to provide strength and reinforcement against both sideways and axial forces. The non-parallel corrugations preferably do not intersect to avoid the creation of stress points which could lead to cracking and flaws in the bottles. Horizontal corrugations are remote from the bottom and shoulder parts of the bottle in order to improve impact resistance.

19 Claims, 1 Drawing Sheet

STACKABLE BOTTLE

This application is a continuation, of application Ser. No. 859,457, filed May 5, 1986.

BACKGROUND OF THE INVENTION

The field of the invention is that of bottles and particularly bottles which may be made of polycarbonate or other plastic substances that may be stacked upon themselves.

Bottles have been used for many years to transport various fluids, the most important of which may be, quite naturally, water. While plastic bottles have been used for many years to package different types of fluids, until recently relatively large containers for water have been glass bottles of round configuration. Such glass bottles were relatively fragile and heavy, and susceptible to fracture into dangerous sharp fragments upon mishandling. The round shape of the bottle required the use of a packaging case for each bottle or an equivalent to stack the bottles for storage or shipment.

Recently, bottles used to transport, contain, and dispense liquids have been made from polycarbonate and other plastics. Such bottles are inexpensive, light, and safe in that they cannot break into dangerous shards when dropped. As with glass bottles, they do not contaminate or taint the liquids that they contain. In the main, plastic bottles have also been round in cross-section because that configuration presents the fewest number of stress points at which leaks might occur. For practical reasons plastic bottles have been relatively thin-walled with corrugations formed therein to provide strength and rigidity.

Recently plastic water bottles have been designed with a rectangular cross-section, and with parallel, relatively flat sides intended to mate with one another. Such bottles may be stacked one above the other. Because of the rectangular cross-section, theoretically no packaging or spacers are needed to support the bottles in proper alignment with respect to each other.

U.S. Pat. No. 4,308,955 to Schieser, et al. provides an example of a plastic rectangular cross-section parallel sided plastic or polycarbonate bottle intended to transport water. This bottle has horizontal reinforcing ribs and grooves formed in its sides. In addition, it has a tenon projecting from one of the parallel sides and a mortice formed in the mating parallel side. When such bottles are stacked on their sides one above the other, the tenon of one bottle can be inserted into the mortice of the immediately adjacent bottle so that the bottles interlock and form a stack.

The interfitting stackable bottles of Schieser, et al. have exhibited certain shortcomings. The horizontal pattern of ribs and grooves, which extend toward the bottom of the bottle, and the raised rib that surrounds the mortice in the female face of the bottle have been found to present stress points where cracks occur during use, with resulting breakage.

The technology of polycarbonate or other plastic parallel sided bottles offers great promise for producing light-weight, inexpensive, durable, and space-saving bottles. An object of the present invention is to provide an improved bottle which may be formed from polycarbonate or other plastics with improved resistance to cracking, leakage, and the like.

SUMMARY OF THE INVENTION

A substantial cause of cracking and other flaws in polycarbonate or other plastic parallel sided bottles is the provision of intersecting vertical and horizontal reinforcing ribs and grooves. As used herein, vertical refers to a direction parallel to or along the axis of the bottle from top to bottom or vice versa when the bottle is placed on a horizontal surface with its top, containing the mouth, uppermost. Concomitantly, horizontal refers to a direction generally perpendicular to a vertical direction or axis of the bottle. Horizontal may also refer to a radial or sideways direction.

In accordance with the present invention, preferably both horizontal and vertical reinforcing corrugations provide strength to the bottle. Vertical corrugation gives the bottle more strength from pressure downwards from the neck and shoulder area or upwards from the bottom area. Horizontal corrugation gives the bottle more strength from pressure exerted from the sides, either into or out of the bottle. A combination of both vertical and horizontal corrugation is desirable, particularly when mating projections and depressions are formed in opposing parallel sides of the bottle for stacking purposes. In this case, vertical corrugation is particularly appropriate for use on the mating projection side of the bottle whereas horizontal corrugation is preferable for use on the mating depression or receptacle side of the bottle. It is desirable that the vertical and horizontal corrugation not intersect so as to avoid the creation of stress points where cracking might occur.

As used herein, the "corrugation" refers to the lands and grooves formed in the sides of the bottle. A corrugation or "one corrugation" refers to one set of a land and a groove, adjacent to each other. A "corrugation width" is the distance across one corrugation, in a direction perpendicular to that taken by the land and groove.

Further, in accordance with the invention, it is preferred that horizontal reinforcing corrugation not be too close to the bottom or to the neck and upper shoulder of the bottle. Too much corrugation overall will have an accordion effect, tending to collapse the bottle in whole or in part. The provision of a smooth side expanse in the region of the bottle adjacent to the bottom and to the neck and upper shoulder tends to absorb shock forces before the forces reach the corrugations. The relatively small radii of the corrugation would otherwise provide stress points which tend to crack under the stress of impact forces caused in a common mishap, i.e. the dropping of a bottle, particularly on one of its bottom corners.

The preferred embodiment of the invention is a bottle comprising a body containing and defining a receptacle, the body having a plurality of sides, a top, and a bottom, two of the sides of the body being parallel and opposed to each other, the body having alternately disposed corrugation formed in the sides of the body for strength, the corrugation formed in a first of the mating parallel sides being generally vertically disposed and the reinforcing corrugation formed in a second of the mating parallel sides being horizontally disposed. The vertical reinforcing corrugation preferably are formed so as to not intersect the horizontal reinforcing corrugation on a mating bottle. It is further preferred that horizontal reinforcing corrugation not be formed in the sides of the bottle adjacent to the bottom or to the top of the bottle sides. A mating projection is formed in one of the parallel sides of the body and complementary mating receptacle is formed in the opposed parallel mating side. It is preferred that the mating projection side have vertically disposed corrugation and the mating receptacle side have horizontally disposed corrugations.

It is therefore an object of the present invention to provide a stackable bottle for the transport of liquids, which may be formed from polycarbonate or other plastic substances that exhibit improved resistance to cracking and leakage. This and other objects and advantages and features of the invention will become apparent to those skilled in the art from the following detailed description of the preferred embodiment with continued reference to the accompanying drawings.

DETAILED DESCRIPTION OF THE PREFERRED EMBODIMENT

Figure 1:
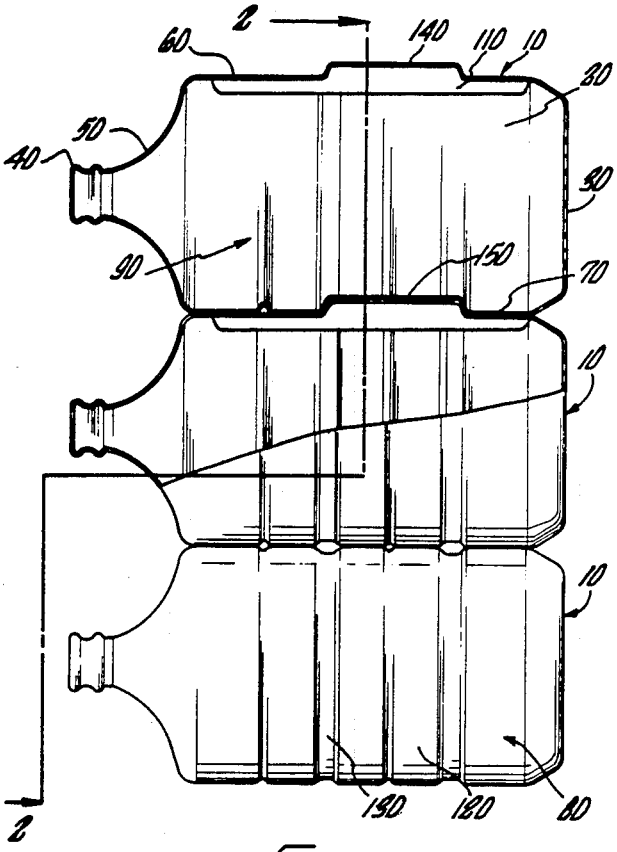
FIG. 1 is a side elevation, partially broken away, of three bottles in accordance with the preferred embodiment of the invention stacked one above the other.
Figure 2:
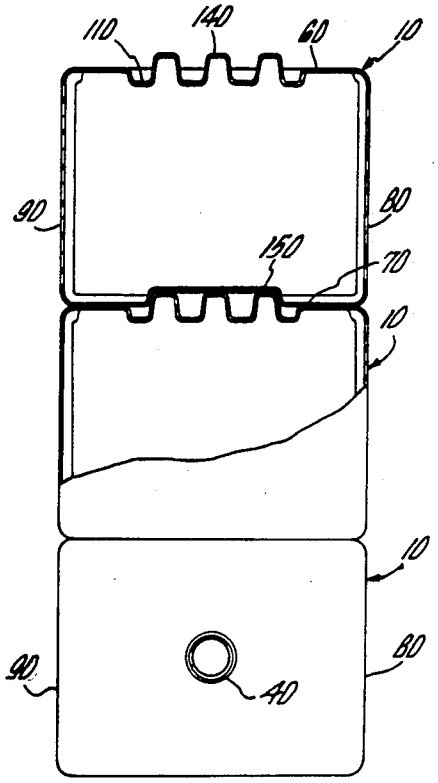
FIG. 2 is an end elevation, partially in section, of the three stacked bottles shown in FIG. 1 taken along line 2—2.

Turning now to the drawings, FIG. 1 shows three bottles in accordance with the preferred embodiment of the invention stacked three high on a flat surface with the mating receptacle side (described below) down and mating projection side up. Portions of the upper two bottles are broken away to show details of their inner construction. The bottle has a body generally designated by the number 10 which defines and surrounds a receptacle generally designated 20 which is, of course, the space to be filled by the liquid that will be contained by the bottle. The bottle has a mouth 40, a neck 50, and a bottom 30. The bottle is preferably rectangular in cross-section, as is best seen in FIG. 2 of the drawings, which is a partial cross-section taken along section line 2—2 in FIG. 1. The preferred embodiment has four sides: a first side generally designated 60, a second side generally designated 70, a third side generally designated 80, and a fourth side generally designated 90. All four sides are seen in cross-section in the top bottle depicted in FIG. 2. In FIG. 1, first side 60, second side 70, and fourth side 90 are seen in the top bottle shown in break-away and third side 80 is shown in the bottom bottle which is not shown in break-away. All four sides may also be seen in the two perspective views of the bottle of the preferred embodiment of the invention shown in FIGS. 3 and 4.

The preferred embodiment of the bottle of the invention represented here is in the form of a polycarbonate bottle for containing and transporting mineral or distilled water, and may be molded according to procedures familiar to those skilled in the art. Other sizes and materials are certainly possible, and other liquids may be transported. The polycarbonate water bottle shown here as the preferred embodiment is for purposes of illustration only.

Stackable bottles must withstand the strains and forces of being lifted, stacked, unstacked, and otherwise handled both when full and empty. To be stackable the invention includes opposed mating side faces 60 and 70 with, respectively, mating projection 140 and complementary mating receptacle 150 so that two of the bottles may be stacked and interlocked as shown in FIGS. 1 and 2. Each side preferably has reinforcing corrugation with some portion of the corrugation being non-aligned with, and desirably substantially normal to, another portion of the corrugation, so as to reinforce the bottle against forces from all directions.

In FIG. 1 may be seen substantially horizontally disposed corrugation comprising lands 120 and grooves 130 that are formed in second side 70, third side 80, and fourth side 90. The horizontal corrugation 120 and 130 is continuous from side 70 to side 80 to side 90.

The horizontal corrugation 120 and 130 provides strength against forces and stresses in a sideways direction, towards or from the axis of the bottle, to make the bottle more rigid against sideways pressures and forces. Such forces could come from the internal pressure of the liquid contained inside the bottle or be the result of outside radial forces applied during handling and transportation, such as the side-against-side pressures of bottles stacked on top of each other.

At least one portion of the side of the bottle includes non-aligned corrugation. In the preferred embodiment mating projection side 60 includes vertical corrugation, i.e., lands 100 and grooves 110, in contradistinction to the horizontal corrugation 120 and 130 employed on sides 70, 80, and 90. Vertical corrugation 100 and 110 provides the bottle with strength against forces downward from the neck 50 area and upward from the bottom 30 area. The combination of vertical corrugation 100 and 110 in conjunction with horizontal corrugation 120 and 130 strengthens the bottle against pressure from both the sideways (radial) and up and down (axial) directions. The size of the horizontal and vertical corrugation will depend on the size of the bottle, the material of the bottle, and a practical trade off between strength and brittleness.

The horizontal corrugation 120 and 130 desirably does not intersect any of vertical corrugation 100 and 110. Such intersections are stress points that may cause local concentrations of forces that can result in flaws and cracking. This may be seen in FIG. 3, which shows the horizontal corrugation 120 and 130 terminating short of the most immediately adjacent vertical groove 110.

Additionally, in the preferred embodiment of the bottle of the invention, the vertical corrugation 100 and 120 of one bottle perpendicularly intersects the horizontal corrugation 120 and 130 of another bottle when the two bottles are stacked so that their mating sides interlock. This arrangement has been found to be particularly advantageous. It contributes to the strength and resiliency of the interlocked bottles and is another reason for using both vertical and horizontal (i.e., non-parallel) corrugation in the same bottle.

The preferred embodiment of the bottle of the invention is also characterized by a mating arrangement which helps align and interlock the bottles when stacked one above the other, as is best seen in FIGS. 1 and 2, or otherwise placed side-by-side. Formed in mating side 70 is a mating receptacle 150, a depressed rectangular region that, in the preferred embodiment, is indented into the side of the bottle even farther than horizontal grooves 110 in a shape complementary to mating projection 140. Labels customarily used by bottled water suppliers to identify their service may be applied in receptacle 150.

The other mating side of the bottle 60, parallel and opposite mating side 70, has a plurality of mating projections 140 formed in and integral with vertical corrugation 100. Mating projection 140 is a sideways extension of the three vertical lands 100 and is sized and shaped to be complementary to receptacle 150.

Figure 4:
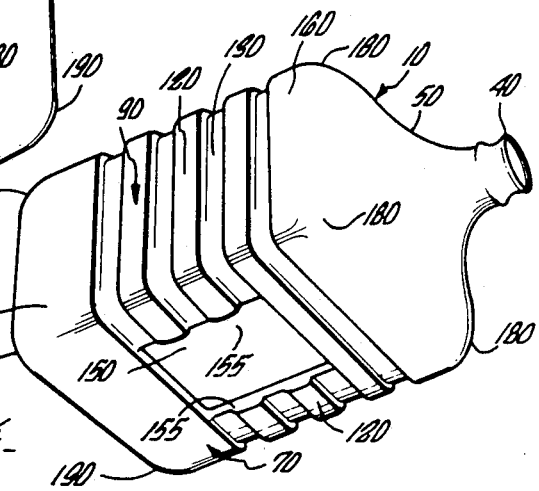
FIG. 4 is a perspective view of the bottle of FIG. 3 showing the horizontally corrugated mating receptacle side.

Looking at FIG. 4 it should be noted that receptacle 150 on the mating side 70 is not framed by ribs on all sides. In particular, on sides 155 of receptacle 150, horizontal lands 120 simply terminate without meeting, for example, a vertical member or framing rib around the receptacle, thereby avoiding the intersection of vertical and horizontal members.

Although the horizontal corrugation 120 and 130 provide valuable sideways strengthening of the bottle of the preferred embodiment of the invention, desirably care is taken to insure that they do not extend too close to the bottom 30 of the bottle or to the top portion of the bottle (where the sides merge into the neck 50 of the bottle). In particular, horizontal corrugation 120 and 130 should not be formed in the upper shoulder 160 or lower shoulder 170 of the bottle. Horizontal corrugation 120 and 130 near the top and bottom can have an accordion effect and weaken the bottle against vertical or axial pressures. Indeed, too much horizontal corrugation could weaken a bottle against collapse in vertical or axial direction if, for example, the bottle were to drop on its bottom 30. Avoiding horizontal corrugation in upper shoulder 160 and lower shoulder 170 will tend to strengthen the bottle against vertical collapse. The small radii of the horizontal corrugation 120 and 130 provide stress points which can crack under the stress of impact forces created when the bottle is dropped or otherwise handled, as when the bottle falls on its bottom 30 or corners 180 or 190. (Top four corners 180 and bottom four corners 190 may be best seen in FIG. 3 and 4 of the drawings.) By eliminating horizontal ribs and grooves in the regions of the bottle adjacent to the bottom 30 and to the neck 50, i.e., in the regions of the upper shoulder 160 and lower shoulder 170, a smooth area is provided to absorb shock before shocks reach the horizontal corrugation 120 and 130..

Figure 3:
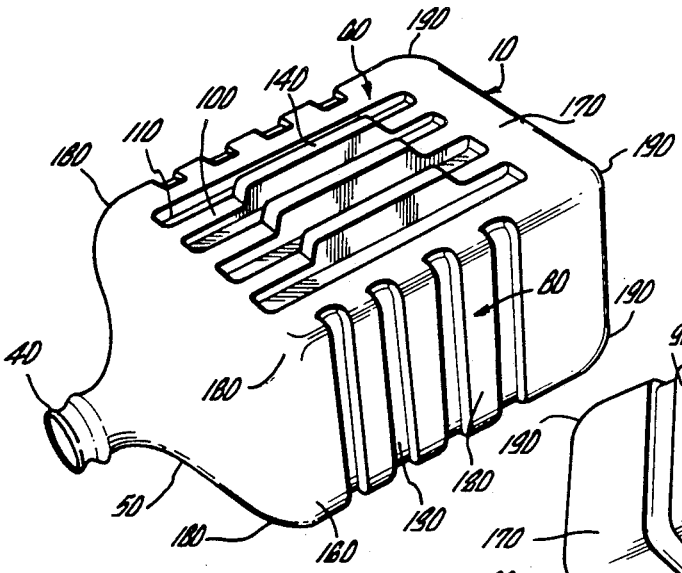
FIG. 3 is a side perspective view of a bottle in accordance with the preferred embodiment showing a vertically corrugated mating projection side.

Consequently, as shown in FIG. 1, 3, and 4, no horizontal corrugation 120 and 130 is formed close to the upper shoulders 160 and lower shoulder 170. The vertical extent of the upper shoulder 160 and lower shoulder 170 that is free from horizontal lands 120 and grooves 130 will depend, as a practical matter, upon the size, material and particular shape of the bottle. For example, in a six gallon water bottle according to the preferred embodiment of the invention, a four inch expanse of lower shoulder 170 with no horizontal corrugation 120 and 130 is sufficient. In the upper shoulder 170, a vertical distance of three inches is satisfactory for a bottle of about fourteen inches from bottom to neck.

Although no definitive formula for calculating the height of the upper shoulder 160 and lower shoulder 170 that should be free of horizontal corrugation can be given, the horizontal corrugation should not be substantially close to the top of the bottle (defined as that plane which intersects the four top corners 180) or to the bottom 30 of the bottle. As a rule of thumb, the distance that is free from horizontal corrugation should be at least as great as the average vertical distance occupied by one horizontal groove and one horizontal land, i.e., the width of a corrugation.

The foregoing detailed description of the preferred embodiment is presented to illustrate the invention by way of example only. Numerous modifications and variations thereof fall within the spirit and scope thereof, which is defined only by the appended claims.

What is claimed is:

1. A bottle comprising a body defining a receptacle, said body having two opposed mating side walls constructed and arranged to permit stacking and mating of two of said bottles when stacked with their opposed side walls mated, a top, a bottom, non-aligned reinforcing corrugation formed in two mating side walls, the reinforcing corrugation in at least one side wall being substantially horizontal, the corrugation in one mating side wall being non-parallel to the corrugation in the other mating side wall.

2. A bottle according to claim 1, wherein the corrugation in one mating side wall is substantially horizontally disposed and the corrugation in the other mating side wall is substantially vertically disposed.

3. A bottle comprising a top portion, a bottom and side walls defining a receptacle, said bottle having two side walls constructed and arranged to permit stacking of two of said bottles when stacked with their opposed side walls mated and side wall reinforcing corrugation, a portion of the side wall reinforcing corrugation being substantially vertical and another portion of the side reinforcing corrugation being substantially horizontal, so as to reinforce the bottle against both horizontal and vertical forces, and a corrugation-free side wall portion on the side wall having the horizontal side wall reinforcing corrugation, disposed between said horizontal corrugation and the bottom to absorb shock from droppage.

4. A bottle according to claim 3 in which the vertical height of the flat vertical corrugation-free side wall portion is at least substantially a corrugation width.

5. A bottle according to claim 4 in which one mating side wall includes at least part of the vertical side wall reinforcing corrugation and another mating side wall includes at least part of the horizontal side wall reinforcing corrugation.

6. A bottle according to claim 3 wherein the vertical side wall reinforcing corrugation and horizontal side wall reinforcing corrugation are constructed and arranged to not intersect.

7. A bottle according to claim 3 wherein said mating side wall faces are opposed side wall faces of the bottle, one mating side wall having horizontal side wall reinforcing corrugation and another mating side wall having vertical side wall reinforcing corrugation.

8. A bottle according to claim 7 wherein one mating side wall includes a plurality of mating projections and vertical side wall reinforcing corrugation and another mating side wall includes a complementary mating receptacle and horizontal side wall reinforcing corrugation.

9. A bottle according to claim 8 constructed and arranged to have no intersection of vertical and horizontal corrugations.

10. A bottle comprising a body defining a receptacle, said body having a rectangular cross-section and at least four side walls, a top, and a bottom, two of said side walls being opposed parallel mating side walls, one of said opposed parallel mating side walls having at least one mating projection and the other of said opposed parallel mating side walls having a complementary mating receptacle to permit stacking of two of said bottles on their mating side walls, said body also having horizontal reinforcing corrugation in at least a first side wall, and vertical reinforcing corrugation in a second side wall, the vertical reinforcing corrugation being non-aligned and non-intersecting with the horizontal reinforcing corrugation, and a corrugation-free side wall portion between said horizontal reinforcing corrugation and the bottom to absorb shock from droppage.

11. A bottle according to claim 10 in which one mating side wall contains at least part of the reinforcing corrugation.

12. A bottle according to claim 11 in which the mating side wall includes vertical reinforcing corrugation having a plurality of mating projections formed in and integral with said corrugation.

13. A bottle according to claim 12 in which the mating receptacle is formed as a depressed rectangular region indented into the mating side wall, said mating receptacle being sized complementary to the mating projections formed in the reinforcing corrugation so as to receive the mating projections.

14. A bottle according to claim 10 in which the height of the corrugation-free side wall portion is at least substantially one corrugation width.

15. A bottle according to claim 14 in which each side wall having horizontal reinforcing corrugation has a corrugation-free side wall portion between said horizontal reinforcing corrugation and the top to absorb shock from droppage.

16. A bottle according to claim 15 wherein the height of the top corrugation-free side wall portion is at least substantially one corrugation width.

17. A bottle comprising a body defining a receptacle, said body having a rectangular cross-section and four faces, a top, and a bottom, two of said faces being first and second opposed parallel mating faces, the first opposed parallel mating face having vertical reinforcing corrugation and a plurality of mating projections formed in and integral with said vertical corrugation, and the second opposed parallel mating faces having horizontal reinforcing corrugation and a depressed region indented into the second opposed parallel mating face, said depressed region being sized complementary to the mating projections formed in the vertical corrugation of the first opposed parallel mating face to permit mating thereof, the mating face having horizontal reinforcing corrugation also having corrugation-free face portions between said horizontal corrugation and the top and the bottom to absorb shock from droppage.

18. The bottle according to claim 17 further comprising horizontal reinforcing corrugation in two faces that are not opposed parallel mating faces, said horizontal reinforcing corrugation being continuous with the horizontal reinforcing corrugation of the second opposed parallel mating face, said horizontal reinforcing corrugation being non-intersecting with the vertical reinforcing corrugation of the first opposed parallel mating face, and the bottle being constructed so as to have no intersection of vertical and horizontal corrugation anywhere.

19. The bottle according to claim 17 in which the height of each of the corrugation-free face portions is at least substantially a corrugation width.

* * * * *